US008766561B2

(12) United States Patent
Esaki et al.

(10) Patent No.: US 8,766,561 B2
(45) Date of Patent: Jul. 1, 2014

(54) LED LIGHTING DEVICE WITH OUTPUT IMPEDANCE CONTROL

(75) Inventors: Sana Esaki, Osaka (JP); Akinori Hiramatsu, Nara (JP)

(73) Assignee: Panasonic Corporation, Osaka (JP)

( * ) Notice: Subject to any disclaimer, the term of this patent is extended or adjusted under 35 U.S.C. 154(b) by 153 days.

(21) Appl. No.: 13/343,827

(22) Filed: Jan. 5, 2012

(65) Prior Publication Data

US 2012/0200230 A1 Aug. 9, 2012

(30) Foreign Application Priority Data

Jan. 5, 2011 (JP) ..... 2011-000457

(51) Int. Cl.
*G05F 1/00* (2006.01)

(52) U.S. Cl.
USPC ..... 315/310; 315/291; 315/247; 315/312; 315/185 S

(58) Field of Classification Search
USPC ..... 315/247, 185 S, 291, 307–312, 224, 315/225, 274
See application file for complete search history.

(56) References Cited

U.S. PATENT DOCUMENTS 7,550,934 B1 6/2009 Deng et al.
8,134,302 B2 3/2012 Yang et al.
2010/0019697 A1 1/2010 Korsunsky et al.
2011/0062876 A1 3/2011 Yang et al.
2011/0068706 A1* 3/2011 Otake et al. ..... 315/291

FOREIGN PATENT DOCUMENTS

JP 2008091436 4/2008
JP 20090232623 4/2011

OTHER PUBLICATIONS

European Search Report dated Apr. 4, 2012 for EP Application No. 12150091.2.

* cited by examiner

*Primary Examiner* — Tuyet Thi Vo
(74) *Attorney, Agent, or Firm* — Waddey Patterson; Mark J. Patterson; Gary L. Montle

(57) ABSTRACT

An LED lighting device is provided with output impedance control to stabilize an optical output across a wide current range. A switching power supply generates the output current, with switching control circuitry to determine switching frequency and an ON period for an associated switch, and to turn on/off the switch according to the determined frequency and ON period. An impedance element is coupled across output terminals for the lighting device, with an impedance value set so that a load current is larger than a current flowing to the impedance element at maximum on-duty of the switch and a current flowing to the impedance element is larger than the load current at minimum on-duty. The impedance element may be a variable impedance element, wherein an impedance control circuit adjusts the variable impedance such that an impedance value for minimum on-duty of the switch is smaller than that for a maximum on-duty.

18 Claims, 6 Drawing Sheets

LED LIGHTING DEVICE WITH OUTPUT IMPEDANCE CONTROL

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: Japanese Patent Application No. 2011-000457, dated Jan. 5, 2011.

BACKGROUND OF THE INVENTION

The present invention relates generally to lighting devices for driving a semiconductor light-emitting element such as a light-emitting diode (LED), and associated illumination fixtures. More particularly, the present invention relates to LED lighting devices with an output impedance element and associated control circuitry for stabilizing an optical output.

Lighting devices for driving a semiconductor light-emitting element are known in the art which can control an optical (lighting) output across a wide range, from a very weak optical output to an optical output of a rated current. One example includes a circuit configuration with a current divider connected in parallel with the semiconductor light-emitting element and diverting a driving current flowing to the semiconductor light-emitting element. A resistor, a current regulation diode or a thermistor may be used as specific examples of the current divider.

A typical application of such a technique, such as may be used in an inspection light source for a solid-state image sensing element, includes an LED driver circuit for sending a relatively small current to an LED with high accuracy. The driver circuit may include a D/A converter and an analog driver. Such an LED driver circuit is relatively expensive and inefficient, making it unsuitable for many illumination fixtures as would be used in homes and offices. Further, power losses due to the current divider are simply disregarded.

In another example, a switching power supply device as known in the art for controlling a semiconductor light-emitting element across a wide range of lighting outputs performs constant current control for outputs near a rated current (high end of the lighting range) so as to match an output current of a switching power supply with a target current value, and performs constant voltage control for outputs at the low end of the lighting range so as to match an output voltage of the switching power supply with a target voltage value.

According to this technique, as compared to the first technique described above, power loss is decreased due to the switching power supply device. However, because the technique requires both a feedback control system for constant current control used in the vicinity of the rated current and a feedback control system for constant voltage control used in the very weak optical output, the circuit configuration disadvantageously becomes complicated and expensive.

BRIEF SUMMARY OF THE INVENTION

An object of the present invention is to provide a semiconductor light-emitting element lighting device which is relatively inexpensive but yields stable lighting control across a wide range from a rated current (high end of the lighting output range) to the very weak optical output (low end of the lighting output range) of a semiconductor light-emitting element, such as an LED.

In an embodiment of the present invention, a lighting device is provided with output impedance control to stabilize an optical output across a wide current range. A switching power supply generates the output current, with switching control circuitry to determine switching frequency and an on-duty time for an associated switch, and to turn on/off the switch according to the determined frequency and on-duty time. An impedance element is coupled across output terminals for the lighting device, with an impedance value set so that the load current is larger than the current flowing to the impedance element at maximum on-duty time of the switch and the current flowing to the impedance element is larger than the load current at minimum on-duty time. The impedance element may be a variable impedance element, wherein an impedance control circuit adjusts the variable impedance such that an impedance value for minimum on-duty time of the switch is smaller than that for a maximum on-duty time.

According to the present invention, even when the lighting device for driving the semiconductor light-emitting element by the switching power supply circuit has a limitation in the control range of the on-duty time of the switching element, the current flowing to the semiconductor light-emitting element can be stably controlled in a wide range and lighting can be stably controlled from the vicinity of the rated current to a very weak optical output.

DETAILED DESCRIPTION OF THE INVENTION

Figure 1:
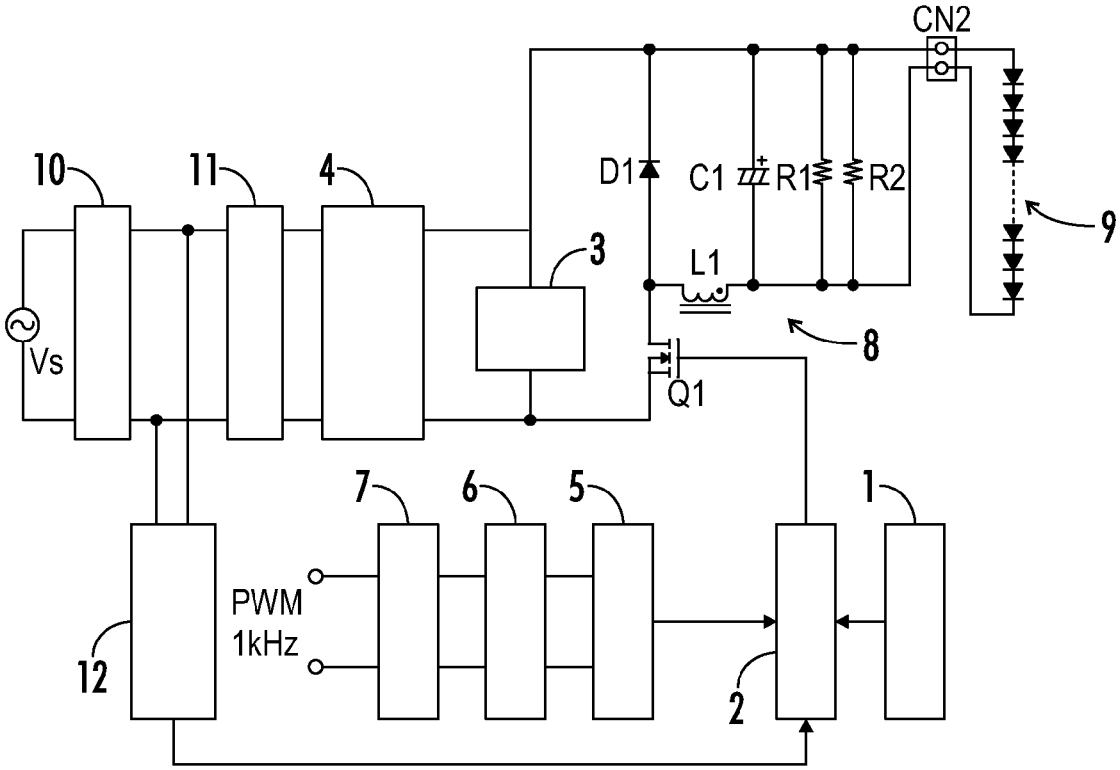
FIG. 1 is a circuit block diagram representing an embodiment of a lighting device according to the present invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" as used herein may include any meanings as may be understood by those of ordinary skill in the art, including at least an electric or magnetic representation of current, voltage, charge, temperature, data or a state of one or more memory locations as expressed on one or more transmission mediums, and generally capable of being transmitted, received, stored, compared, combined or otherwise manipulated in any equivalent manner.

The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

The terms "controller" or "control circuit" as may be used interchangeably herein refer to at least a general microprocessor, an application specific integrated circuit (ASIC), a digital signal processor (DSP), a microcontroller, a field programmable gate array, or various alternative blocks of discrete circuitry as known in the art, designed to perform functions as further defined herein.

Referring generally to FIGS. 1-9, various embodiments may be described herein of a lighting device for driving a semiconductor lighting emitting element, such as an LED. Where the various figures may describe embodiments sharing various common elements and features with other embodiments, similar elements and features are given the same reference numerals and redundant description thereof may be omitted below.

Figure 2:
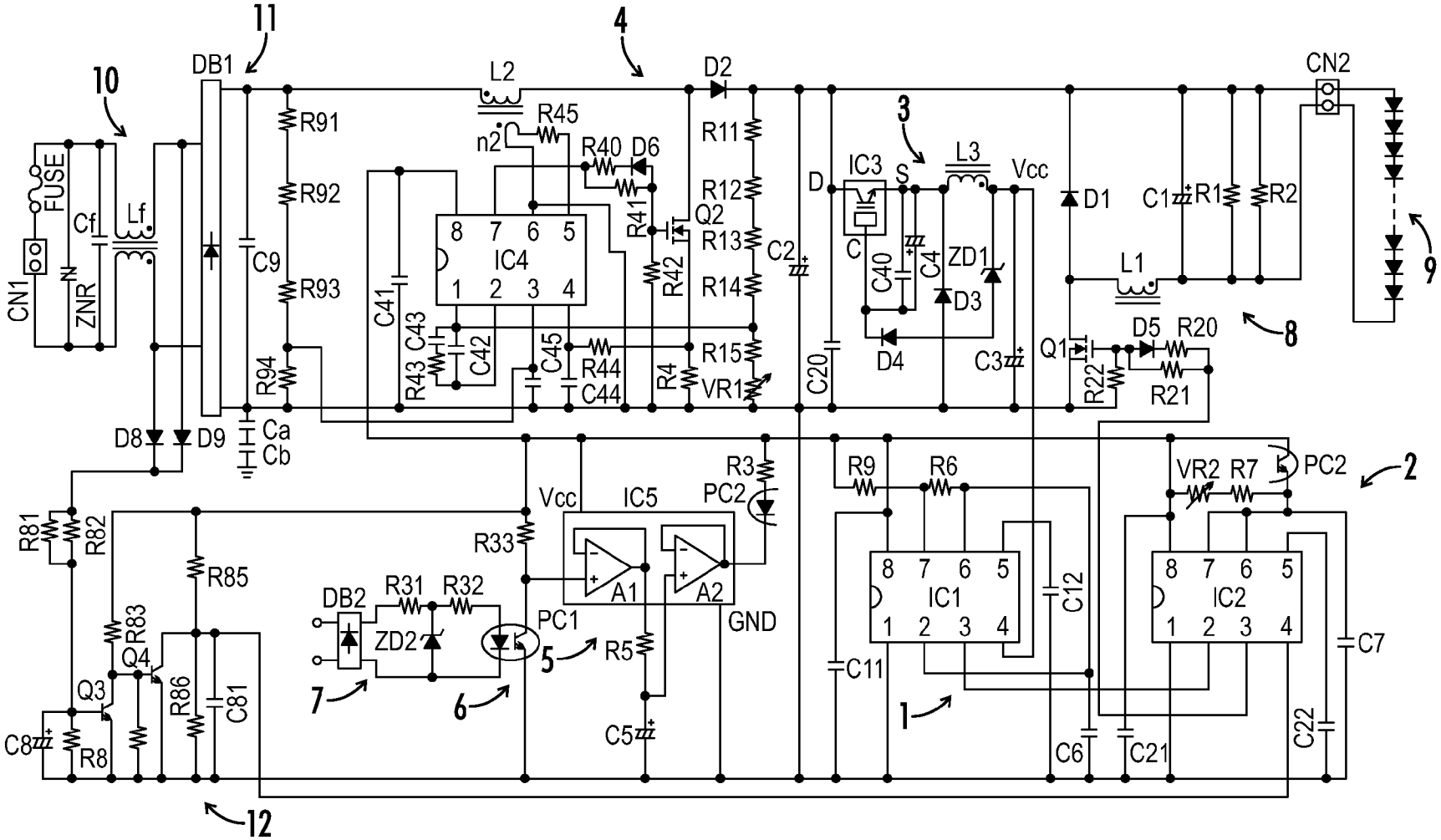
FIG. 2 is a circuit diagram representing the lighting device of FIG. 1 in detail.

An exemplary embodiment of a lighting device of the present invention as represented generally in FIG. 1 may be described in particular detail with reference further to FIG. 2. A high-frequency oscillating circuit 1 and a PWM control circuit 2 as shown are configured with general-purpose timer integrated circuits IC1, IC2 and their peripheral circuitry, and may collectively define a switching control circuit. The high-frequency oscillating circuit 1 sets an ON/OFF frequency of a switching element Q1 and the PWM control circuit 2 sets an ON pulse width of the switching element Q1.

The timer integrated circuits IC1, IC2 each are a well-known timer IC (for example, a 555 timer IC such as the μPD5555 manufactured by Renesas Electronics Corporation (under control of former NEC Electronics) or its dual version (μPD5556), or their compatible or equivalent devices. The first pin is a ground terminal and the eighth pin is a power terminal. Capacitors C11, C21 connected between the power terminal and the ground terminal are each a small-capacitance capacitor for power source bypass and filtering the noise of a power source voltage Vcc.

The second IC pin is a trigger terminal and when the terminal voltage is less than half of the voltage at the fifth pin (typically, one third of the power source voltage Vcc), an internal flip-flop is inverted, so that the third pin (output terminal) is forced to a High level and the seventh pin (discharging terminal) is opened. The fourth pin is a reset terminal and when this terminal is forced Low, operation is disabled so that the third pin (output terminal) is also forced Low.

The fifth pin is a control terminal and a reference voltage that typically becomes two thirds of the power source voltage Vcc due to a built-in voltage dividing resistor is applied to this pin. Capacitors C12, C22 connected between the fifth pin and the first pin are each a small-capacitance bypass capacitor for filtering noise of the reference voltage.

The sixth IC pin is a threshold terminal, and when the voltage at this terminal becomes higher than the voltage at the fifth pin (typically, two thirds of the power source voltage Vcc), the internal flip-flop is inverted, so that the third pin (output terminal) becomes Low and the seventh pin (discharging terminal) is short-circuited to the first pin.

The first timer integrated circuit IC1 (the high-frequency oscillating circuit 1 in FIG. 1), to which time constant setting resistors R6, R9 and a capacitor C6 are externally attached, operates as an astable multivibrator. The voltage at capacitor C6 is input to the second pin (trigger terminal) and the sixth pin (threshold terminal), and is compared with the internal reference voltages (one-third and two-thirds of the power source voltage Vcc).

In an initial period after power-on, because the voltage of the capacitor C6 is lower than the reference voltage (one third of the power source voltage Vcc) compared at the second pin (trigger terminal), the third pin (output terminal) goes High and the seventh pin (discharging terminal) is opened. Thereby, the capacitor C6 is charged from the power source voltage Vcc via the resistors R9, R6.

When the voltage at capacitor C6 becomes higher than the reference voltage (two thirds of the power source voltage Vcc) at the sixth pin (threshold terminal), the third pin (output terminal) goes Low and the seventh pin (discharging terminal) is short-circuited to the first pin. Thereby, the capacitor C6 is discharged via the resistor R6.

When the voltage at capacitor C6 falls below the reference voltage (one third of the power source voltage Vcc) at the second pin (trigger terminal), the third pin (output terminal) is forced High and the seventh pin (discharging terminal) is opened. Thereby, the capacitor C6 is recharged from the power source voltage Vcc via the resistors R9, R6. Thereafter, the same operation is repeated.

The time constants of the resistors R9, R6 and the capacitor C6 are set so that the oscillating frequency of the third pin (output terminal) becomes a high frequency of a few dozens of kHz. The resistance values of the resistors R6, R9 are set so that the resistance value of R6 is smaller than that of R9. For this reason, the period when the capacitor C6 is discharged via the resistor R6 (wherein the output terminal of the third pin is Low) becomes substantially smaller than the period when the capacitor C6 is charged via the resistors R6, R9 (wherein the output terminal of the third pin is High). Thus, a Low level pulse having a small pulse width is repeatedly output at the high frequency (e.g., a few dozens of kHz) from the third pin (output terminal) of the first timer integrated circuit IC1 configuring the high-frequency oscillating circuit 1. Using the falling pulse having the small pulse width, the second pin of the second timer integrated circuit IC2 is triggered only once per cycle.

The second timer integrated circuit IC2 defining the PWM control circuit 2 in FIG. 2 operates as a monostable multivibrator to which a time constant setting resistor R7, a variable resistor VR2 and a capacitor C7 are externally attached. A light-receiving element of a photo-coupler PC2 is coupled to a series circuit including the time constant setting resistor R7 and the variable resistor VR2 in parallel, thereby variably controlling the pulse width of the monostable multivibrator according to an optical signal intensity of the photo-coupler PC2. When a Low level pulse having a small pulse width is input to the second pin (trigger terminal) of the second timer integrated circuit IC2, at its falling edge, the third pin (output terminal) of the second timer integrated circuit IC2 is forced High and the seventh pin (discharging terminal) is opened. For this reason, the capacitor C6 is charged via the series circuit including the time constant setting resistor R7 and the variable resistor VR2, and the light-receiving element of the photo-coupler PC2. When the charging voltage becomes higher than the reference voltage (two thirds of the power source voltage Vcc) compared at the sixth pin (threshold terminal), the third pin (output terminal) is forced Low and the seventh pin (discharging terminal) is short-circuited to the first pin. As a result, the capacitor C7 is spontaneously discharged.

Accordingly, the pulse width of a High level pulse signal output from the third pin of the second timer integrated circuit IC2 is determined based on the time required to charge the capacitor C7 from a ground voltage to the reference voltage (two thirds of the power source voltage Vcc). A maximum value of the time is set to be shorter than an oscillating cycle of the first timer integrated circuit IC1 configuring the high-frequency oscillating circuit 1. A minimum value of the time is set to be longer than the pulse width of the Low level trigger pulse output from the third pin of the first timer integrated circuit IC1.

The High level pulse signal output from the third pin of the second timer integrated circuit IC2 becomes an ON driving signal of the switching element Q1. When the third pin of the IC2 is High, current flows to a resistor 22 via a resistor 21, the voltage across the resistor 22 becomes a gate-source threshold voltage of the switching element Q1 or larger and the switching element Q1 is turned on. When the third pin of the IC2 is Low, the charge across the gate and the source of the switching element Q1 is drawn out via a diode D5 and a resistor R20, so that the switching element Q1 is turned off.

The configuration of a lighting control circuit for supplying an optical signal to the light-receiving element of the photo-coupler PC2 may now be described. The lighting control circuit includes a DC converter 5, an isolation circuit 6 and a non-polarizing circuit 7 in FIG. 1.

A lighting control (dimming control) signal input to the lighting control circuit may be a PWM signal including a pulse-width modulated rectangular wave voltage signal having a frequency of 1 kHz and an amplitude of 10 V, as is conventionally used as a lighting control (dimming control) signal of an inverter lighting device for a fluorescent lamp. A lighting control signal line for transmitting the lighting control signal may be installed separately from a power line on each illumination fixture.

The non-polarizing circuit 7 in FIG. 1 is realized as a full-wave rectifier DB2 in FIG. 2, and an AC input terminal of the full-wave rectifier DB2 is coupled to the lighting control signal line so as to normally operate even if the lighting control signal line is connected with reverse polarity. A Zener diode ZD2 is coupled across DC output terminals of the full-wave rectifier DB2 via a resistor R31, and a light-emitting element of the photo-coupler PC1 is coupled across the Zener diode ZD2 via a resistor R32.

The photo-coupler PC1 in FIG. 2 functions as the isolation circuit 6 in FIG. 1. Generally, a plurality of illumination fixtures are coupled to the lighting control signal line and the power line in parallel. In this case, because the circuit ground of each illumination fixture is not necessarily at the same potential, it may be necessary to isolate the lighting control signal line from the circuit ground of each illumination fixture. The light-emitting element of the photo-coupler PC1 is coupled to the lighting control signal line, and the light-receiving element is coupled between the circuit ground of the illumination fixture and the power source voltage Vcc, in series with a resistor R33.

When the PWM signal of the lighting control signal line is High, because the light-emitting element of the photo-coupler PC1 emits an optical signal and the resistance value of the light-receiving element of the photo-coupler PC1 decreases, the voltage decreases at the node between the resistor R33 and the light-receiving element of the photo-coupler PC1. Conversely, when the PWM signal of the lighting control signal line is Low, because the light-emitting element of the photo-coupler PC1 emits no optical signal and the resistance value of the light-receiving element of the photo-coupler PC1 increases, the voltage increases at the node between the resistor R33 and the light-receiving element of the photo-coupler PC1. Although this voltage change is repeated at the frequency (1 kHz) of the lighting control signal, the voltage is converted into a DC voltage by smoothing via a time constant circuit including a resistor R5 and a capacitor C5.

The DC converter 5 of FIG. 1 in an embodiment may include an integrated circuit IC5 having operational amplifiers A1, A2 as represented in FIG. 2 therein, the resistor R5 and the capacitor C5. For example, μPC358 manufactured by Renesas Electronics Corporation (under control of former NEC Electronics) or its compatible devices may be used as the integrated circuit IC5. The operational amplifier A1 is used as a buffer amplifier, amplifies the voltage at the node between the resistor R33 and the light-receiving element of the photo-coupler PC1 to have a low impedance and applies the voltage to the series circuit including the resistor R5 and the capacitor C5.

In a case where the PWM signal of the lighting control signal is Low for a relatively long period, because the period when the capacitor C5 is charged via the resistor R5 increases, the voltage at capacitor C5 increases. Conversely, in a case where the PWM signal of the lighting control signal is High for a relatively long period, because the period when the capacitor C5 is discharged via the resistor R5 increases, the voltage at capacitor C5 decreases. The voltage at capacitor C5 is amplified by the buffer amplifier as the operational amplifier A2 to have a low impedance and is provided as an output for driving the light-emitting element of the photo-coupler PC2.

When the voltage at capacitor C5 is low, because the output voltage of the operational amplifier A2 is also low, the current flowing to the light-emitting element of the photo-coupler PC2 from the power source voltage Vcc via a resistor R3 increases and a resistance value of the light-receiving element of the photo-coupler PC2 decreases. That is, in the case where the PWM signal of the lighting control signal is High for a long period, the ON pulse width of the switching element Q1, which is set by the PWM control circuit 2, becomes short and the optical output of a semiconductor light-emitting element 9 decreases.

Conversely, when the voltage at capacitor C5 is high, because the output voltage of the operational amplifier A2 becomes high, the current flowing to the light-emitting element of the photo-coupler PC2 from the power source voltage Vcc via the resistor R3 decreases and the resistance value of the light-receiving element of the photo-coupler PC2 increases. That is, in the case where the PWM signal of the lighting control signal is Low for a long period, the ON pulse width of the switching element Q1, which is set by the PWM control circuit 2, becomes long and the optical output of the semiconductor light-emitting element 9 increases. Therefore, in a case where the lighting control signal line is broken, the optical output of the semiconductor light-emitting element 9 is at its maximum.

A configuration of a step-down chopper circuit 8 for stepping down a DC voltage of a smoothing capacitor C2 as a DC power source to charge the smoothing capacitor C1 may now be described. A positive terminal of the smoothing capacitor C2 is connected to a positive terminal of the smoothing capacitor C1. A negative terminal of the smoothing capacitor C1 is connected to a drain terminal of the switching element Q1 (e.g., a MOSFET) and the anode terminal of the diode D1 via the inductor L1. The cathode terminal of the diode D1 is connected to the positive terminal of the smoothing capacitor C1. The source terminal of the switching element Q1 is connected to a negative terminal of the smoothing capacitor C2.

When the switching element Q1 is turned on, current flows from the smoothing capacitor C2 as the DC power source via the smoothing capacitor C1, the inductor L1 and the switching element Q1. When the switching element Q1 is turned off, energy stored in the inductor L1 is discharged to the smoothing capacitor C1 via the diode D1. Resistors R1, R2 are coupled across the smoothing capacitor C1 in parallel. The voltage across the resistors R1, R2 is supplied to the semiconductor light-emitting element 9 via an output connector CN2. The semiconductor light-emitting element 9 may be an LED module formed by connecting a plurality of LEDs in serial, in parallel or a hybrid combination of the same.

Figure 3:
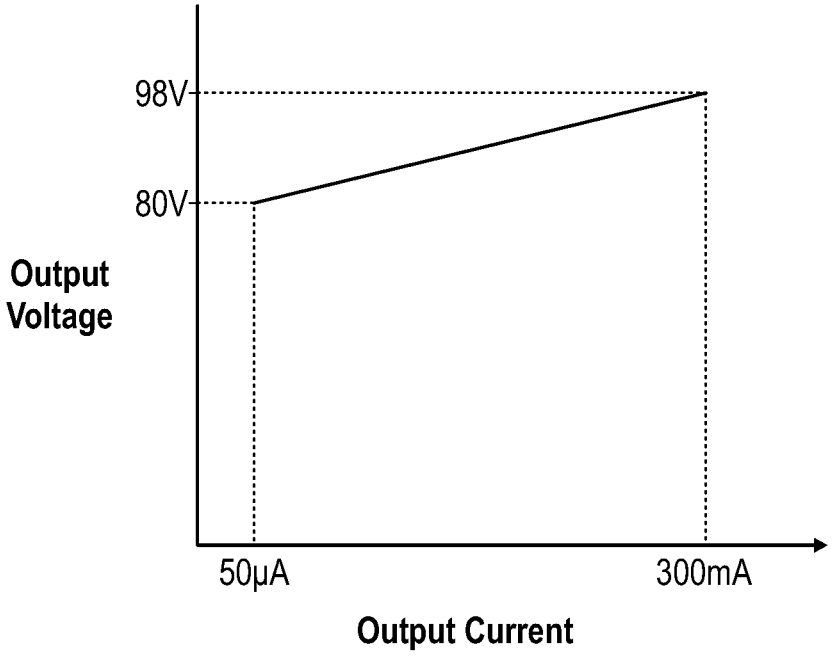
FIG. 3 is a graphical diagram representing an exemplary operation of the lighting device of FIG. 1.

In the embodiment shown in FIG. 2, a resistor of 27 kΩ, 3 W may be used as each of the resistors R1, R2. Accordingly, the value of an impedance element formed by connecting the resistors R1, R2 in parallel may be 13.5 kΩ. A 150 μF electrolytic capacitor may be used as the smoothing capacitor C1. The semiconductor light-emitting element 9 may be formed by serially connecting 32 LEDs. In operation, at full lighting the current will be 300 mA and the voltage will be 98 V. The current flowing to the semiconductor light-emitting element 9, as represented in FIG. 3, could be controlled to fall within a range of 50 μA to 300 mA. The voltage at semiconductor light-emitting element 9 modulated within a range from 80 V to 98 V. A current of about 6 to 7 mA flows through the resistors R1, R2 at all times.

Because the PWM control circuit 2 for setting the ON pulse width of the switching element Q1 has a control limit in a ratio of the maximum pulse width to the minimum pulse width, although the output in a four-digit dynamic range of 50 μA to 300 mA cannot be directly achieved, a two-digit dynamic range of (6 mA+50 μA) to (7 mA+300 mA) can be achieved by providing an idling current of about 6 to 7 mA to the resistors R1, R2 at all times. That is, the resistors R1, R2 act to extend the dynamic range of the current flowing to a load via the output connector CN2.

The resistors R1, R2 also act to decrease the source impedance when viewing the power source device from the semiconductor light-emitting element 9 via the output connector CN2. When the load impedance is extremely high, if the source impedance also remains high, the load voltage is unstable, reducing the ability to respond to changes in the optical output. The parallel circuit as represented in FIG. 2, including the resistors R1, R2, passes the idling current of about 6 to 7 mA in a stable fashion, thereby generating a stable voltage across the resistors R1, R2. Thus, even when the impedance of the semiconductor light-emitting element 9 is extremely high, the voltage across the semiconductor light-emitting element 9 can be prevented from being unstable. This can stably control the optical output across a wide range from very weak output current up to the rated current.

In an embodiment as described above, because it is not necessary to intermittently disable oscillating operation of the step-down chopper circuit 8 at low frequency lighting control outputs, especially when the degree of lighting control is low, the optical output may have a substantially reduced amount of flicker. Further, because voltage feedback control and current feedback control are not required, the configuration is simple and thus can be realized at relatively low cost. Testing confirms that lighting control can be stably achieved with a current of 10 μA at minimum without voltage feedback control.

A commercial AC power source (AC 100 V, 50/60 Hz) may be connected to an input connector CN1. The input connector CN1 is connected to an input terminal of a line filter Lf via a current fuse FUSE. A surge voltage protecting element ZNR and a filter capacitor Cf are connected to the input terminal of the line filter Lf in parallel. An output terminal of the line filter Lf is connected to an AC input terminal of a full-wave rectifier DB.

A capacitor C9 is coupled across DC output terminals of the full-wave rectifier DB1 in parallel. The capacitor C9 is used for high-frequency bypass and does not have a smoothing effect. A negative DC output terminal of the full-wave rectifier DB1 is a ground on a circuit substrate and is high-frequency grounded to a chassis potential FG via a series circuit including capacitors Ca, Cb.

The positive terminal of the DC output terminals of the full-wave rectifier DB1 is connected to the drain terminal of a switching element Q2 (e.g., a MOSFET) and the anode terminal of a diode D2 via an inductor L2. The source terminal of the switching element Q2 is connected to the negative DC output terminal of the full-wave rectifier DB1 via a current detecting resistor R4. The cathode terminal of the diode D2 is connected to a positive terminal of the smoothing capacitor C2. A negative terminal of the smoothing capacitor C2 is connected to the negative DC output terminal of the full-wave rectifier DB1.

The step-up chopper (e.g., a power factor correction—PFC) circuit 4 includes the inductor L2, the switching element Q2, the diode D2 and the smoothing capacitor C2. The operation of the step-up chopper circuit 4 is well known, and the switching element Q2 is turned on/off at a high frequency, thereby increasing the pulsating voltage output from the full-wave rectifier DB1 to generate a DC voltage smoothed by the smoothing capacitor C2 (e.g., DC 410V).

The smoothing capacitor C2 is a large-capacitance capacitor such as an aluminum electrolytic capacitor and is connected in parallel with a small-capacitance capacitor C20 for high-frequency bypass. The capacitor C20 may be for example, a film capacitor and bypasses a high-frequency component flowing to the smoothing capacitor C2.

An exemplary PFC control circuit IC4 is L6562A manufactured by STMicroelectronics Corporation. This IC turns off the switching element Q2 when the current through switching element Q2, which is detected at a fourth pin, reaches a predetermined peak value, and turns on the switching element Q2 again when the discharge of energy in the inductor L2, which is detected at a fifth pin, disappears. Further, the IC controls a target value of a peak current of the switching element Q2 so as to make ON time of the switching element Q2 long when the pulsating voltage detected at a third pin is high and conversely, make the ON time of the switching element Q2 short when the pulsating voltage is low. Furthermore, the IC controls the target value of the peak current of the switching element Q2 so as to make the ON time of the switching element Q2 short when the output voltage of the smoothing capacitor C2, which is detected at the first pin, is higher than the target value and conversely, make the ON time of the switching element Q2 short when the output voltage of the smoothing capacitor C2 is lower than the target value.

The first pin (INV) is an inverting input terminal of a built-in error amplifier, the second pin (COMP) is an output terminal of the error amplifier, the third pin (MULT) is an input terminal of a built-in multiplier circuit, the fourth pin (CS) is a chopper current detecting terminal, the fifth pin (ZCD) is a zero cross detecting terminal, the sixth pin (GND) is a ground terminal, the seventh pin (GD) is a gate drive terminal and the eighth pin (Vcc) is a power terminal.

The voltage across the capacitor C9 as an input voltage of the step-up chopper circuit 4 becomes a pulsating voltage obtained by full-wave rectifying the AC power source voltage. The pulsating voltage is divided by resistors R91 to R93 and resistor R94 and is input to the third pin of the PCF control circuit IC4. The multiplier circuit (not shown) in the IC, which is connected to the third pin, is used to allow a peak value of an input current drawn from the commercial AC power source via the full-wave rectifier DB1 to be similar to a pulsating voltage waveform.

The DC voltage at smoothing capacitor C2 is divided by a series circuit including resistors R11 to R14 and a series circuit including a resistor R15 and a variable resistor VR1, and is input to the first pin of the PCF control circuit IC4. Capacitors C42, C43 and resistor R43 that are connected between the first pin and the second pin are feedback impedances of the error amplifier in the IC.

The voltage across the current detecting resistor R4 is input to a fourth pin of the PCF control circuit IC4 via a noise filter circuit including a resistor R44 and a capacitor C44. One end of a secondary winding n2 of the inductor L2 is connected to the sixth pin of the PCF control circuit IC4 and the circuit ground, and the other end is input to the fifth pin of the PCF control circuit IC4 via a resistor R45.

The seventh pin of the PCF control circuit IC4 is the gate drive terminal. When the seventh pin is High, current flows to a resistor R42 via a resistor R41 and the voltage across the resistor R42 increases to meet or exceed a gate-source threshold voltage of the switching element Q2, thereby turning on the switching element Q2. When the seventh pin is Low, a stored charge between the gate and the source of the switching element Q2 is discharged via a diode D6 and a resistor R40, thereby turning off the switching element Q2.

A control power supply circuit 3 including an IPD element IC3 and its peripheral circuitry is connected to the smoothing capacitor C2. The IPD element IC3 may be an intelligent power device such as, for example, an MIP2E2D manufactured by Panasonic Corporation. This device is a three-pin IC having a drain terminal D, a source terminal S and a control terminal C and includes a switching element (e.g., a power MOSFET) and a control circuit for controlling ON/OFF operation of the switching element therein.

A step-down chopper circuit includes the switching element included between the drain terminal D and the source terminal S of the IPD element IC3, an inductor L3, a smoothing capacitor C3 and a diode D3. A power source circuit of the IPD element IC3 includes a Zener diode ZD1, a diode D4, a smoothing capacitor C4 and a capacitor C40. The smoothing capacitor C3 supplies the control power supply voltage Vcc to other integrated circuits IC1, IC2, IC4 and IC5. Accordingly, the other integrated circuits IC1, IC2, IC4 and IC5 do not operate until the IPD element IC3 starts its operation.

In the initial period after power-on, when the smoothing capacitor C2 is charged with the output voltage of the full-wave rectifier DB1 via the diode D2 and the inductor L2, current flows in a path of the drain terminal D and the control terminal C of the IPD element IC3, the smoothing capacitor C4, the inductor L3 and the smoothing capacitor C3, so that the smoothing capacitor C4 is charged with the shown polarity. The voltage of the smoothing capacitor C4 becomes an operating power source for the control circuit in the IPD element IC3 and the IPD element IC3 starts its operation, thereby turning on/off the switching element between the drain terminal D and the source terminal S.

While the switching element between the drain terminal D and the source terminal S of the IPD element IC3 is turned on, current flows in a path of the smoothing capacitor C2, the drain terminal D and the source terminal S of the IPD element IC3, the inductor L3 and the smoothing capacitor C3, so that the smoothing capacitor C3 is charged. When the switching element is turned off, energy stored in the inductor L3 is discharged to the smoothing capacitor C3 via the diode D3. Thereby, the circuit including the IPD element IC3, the inductor L3, the diode D3 and the smoothing capacitor C3 operates as the step-down chopper circuit, and the control power supply voltage Vcc obtained by lowering the voltage of the smoothing capacitor C2 is obtained by the smoothing capacitor C3.

While the switching element between the drain terminal D and the source terminal S of the IPD element IC3 is turned off, a regenerating current flows via the diode D3. At this time, however, voltage across the inductor L3 is clamped to a sum (Vc3+Vd3) of a voltage Vc3 of the smoothing capacitor C3 and a forward voltage Vd3 of the diode D3. A voltage obtained by subtracting a sum of a Zener voltage Vz1 of the Zener diode ZD1 and a forward voltage Vd4 of the diode D4 (Vz1+Vd4) from the voltage (Vc3+Vd3) becomes a voltage Vc4 of the capacitor C4. The control circuit included in the IPD element IC3 turns on/off the switching element between the drain terminal D and the source terminal S of the IPD element IC3 so that the voltage Vc4 of the capacitor C4 connected between the source terminal S and the control terminal C becomes constant. As a result, the voltage of the smoothing capacitor C3 is controlled so as to be constant, which can feed the operating power source for the IPD element IC3 at the same time.

When the control power supply voltage Vcc is obtained by the smoothing capacitor C3, the PFC control circuit IC4 starts its operation, the step-up chopper circuit 4 starts its operation and the timer integrated circuits IC1, IC2 also start their operation, thereby turning on/off the switching element Q1 at high frequency. Further, the buffer operational amplifier IC5 starts its operation, enabling the lighting control operation.

The anode terminals of diodes D8, D9 are connected to an AC input terminal of the full-wave rectifier DB1. The cathode terminals of the diodes D8, D9 are connected to a base terminal of a transistor Q3 via a parallel circuit including the resistor R81, R82. A time constant circuit including a parallel circuit including capacitor C8 and a resistor R8 is connected between the base terminal and emitter terminal of the transistor Q3. The emitter terminal of the transistor Q3 is connected to the negative terminal of the DC output terminals of the full-wave rectifier DB1.

When the commercial AC power source is energized, the capacitor C8 is charged via the diode D8 or D9 and the resistors R81, R82, thereby turning on the transistor Q3. Thus, a bias current of a transistor Q4 via a resistor R83 is bypassed to the transistor Q3 and the transistor Q4 is kept in an OFF state. When the commercial AC power source is blocked, the charging path of the capacitor C8 disappears and thus, the charge in the capacitor C8 is discharged via the resistor R8. By appropriately setting the time constant of the capacitor C8 and the resistor R8, when the commercial AC power source is blocked over a plurality of cycles, the transistor Q3 is turned off. When the transistor Q3 is turned off, because the smoothing capacitor C3 can stably obtain the control power supply voltage Vcc while a charge remains in the smoothing capacitor C2, current flows to a resistor R84 via the resistor R83 and the transistor Q4 is forward biased and turned on.

While the transistor Q4 is turned off, a series circuit including resistors R85, R86 divides the power source voltage Vcc and supplies an enable signal to the fourth pin of the second timer integrated circuit IC2. A capacitor C81 connected to the resistor R86 in parallel is a small-capacitance capacitor for noise filtering.

When the transistor Q4 is turned on, the enable signal is bypassed to the transistor Q4 and the fourth pin (reset terminal) of the second timer integrated circuit IC2 is forced Low. As a result, because operation of the IC2 is stopped, the switching element Q1 is fixed to an OFF state. The power disconnection detecting circuit 12 in FIG. 1 is configured in this manner.

Figure 4:
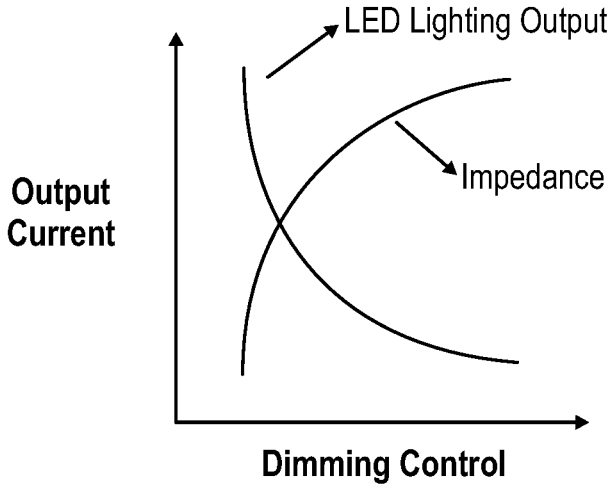
FIG. 4 is a graphical diagram representing another embodiment of an operation according to the present invention.

Referring to an example as represented in FIG. 4, current flowing to the impedance element coupled in parallel with the semiconductor light-emitting element increases in conjunction with a greater degree of lighting control (i.e., that which produces a reduced lighting output).

Figure 5:
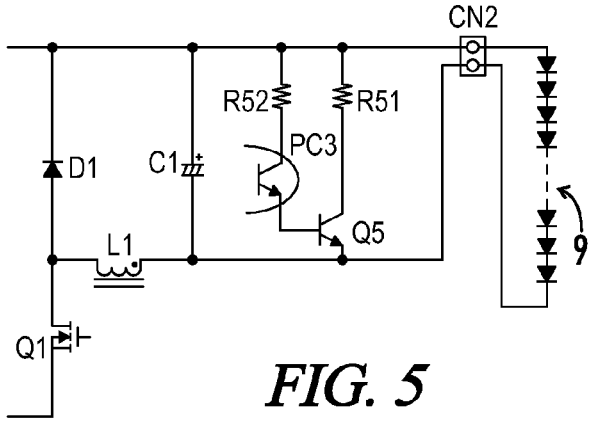
FIG. 5 is a circuit diagram representing another embodiment of an output portion of the lighting device of the present invention.

Referring now to FIG. 5, in an embodiment a variable impedance circuit including resistors R51, R52, a light-receiving element of a photo-coupler PC3 and a transistor Q5 may be connected in place of the parallel circuit including the resistors R1, R2 in FIG. 1 or FIG. 2. Otherwise, the configuration may be substantially the same as that previously described. The light-emitting element (not shown) of the photo-coupler PC3 may be serially connected to the light-emitting element of the photo-coupler PC2 in FIG. 2 or may be commonly used.

In conjunction with a greater degree of lighting control (i.e., a decreased current flowing to the light-emitting diode (LED)), the resistance value of the light-receiving element of the photo-coupler PC3 is decreased. As a result, because base current flowing to the transistor Q5 via the resistor R52 increases and the resistance value of the transistor Q5 decreases, the idling current flowing via the resistor R51 increases. This stabilizes the operation at a time when the degree of lighting control is relatively deep.

Conversely, with reduced levels of lighting control wherein the current flowing to the light-emitting diode (LED) increases, the resistance value of the light-receiving element of the photo-coupler PC3 increases. As a result, because the base current flowing to the transistor Q5 via the resistor R52 decreases and the resistance value of the transistor Q5 increases, the idling current flowing via the resistor R51 decreases. This can reduce power loss at a time when the degree of lighting control is relatively shallow.

Figure 6:
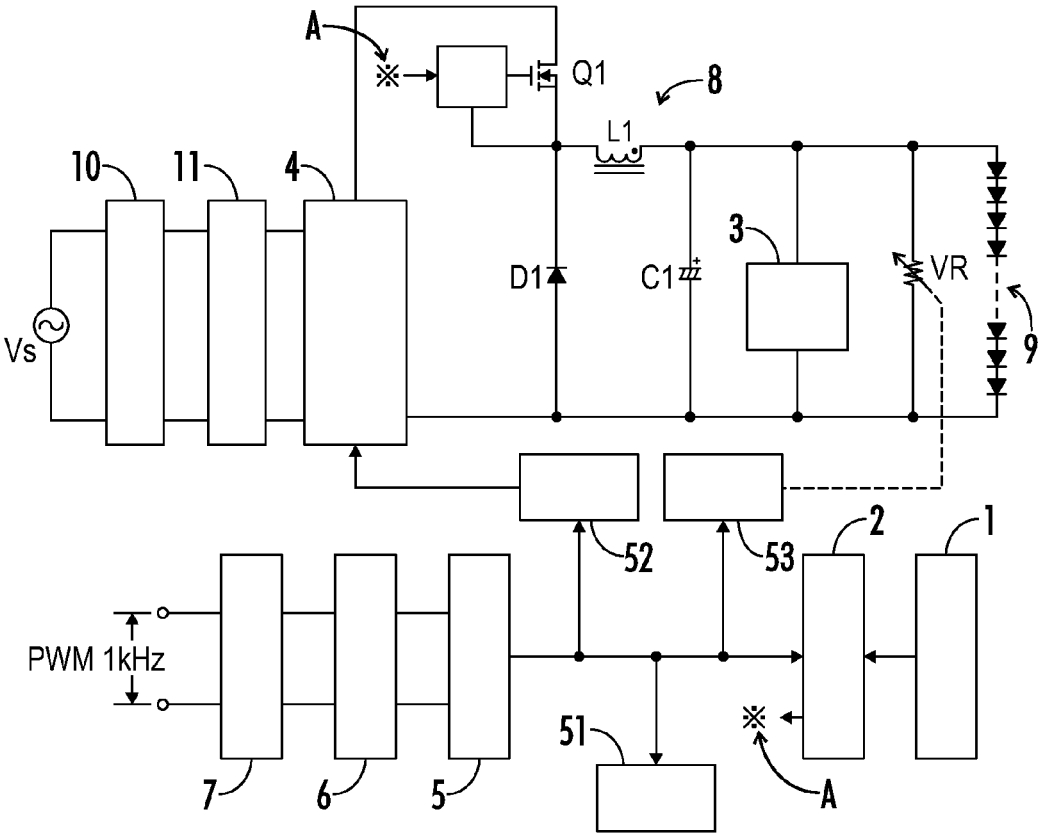
FIG. 6 is a circuit block diagram representing another embodiment of a lighting device according to the present invention.

Referring now to FIG. 6, in another embodiment of the present invention the switching element Q1 may be arranged on a high-potential side and the semiconductor light-emitting element 9 arranged on a low-potential side. The control power supply circuit 3 is coupled in parallel with the semiconductor light-emitting element 9. The control power supply circuit 3 supplies operating power to the high-frequency oscillating circuit 1, the PWM control circuit 2, a control circuit of the step-up chopper circuit 4 and the DC converting circuit 5.

A frequency control circuit 51 for setting the oscillating frequency of the high-frequency oscillating circuit 1, a boost ratio control circuit 52 for setting a boost ratio of the step-up chopper circuit 4 and an impedance control circuit 53 for setting an impedance value of a variable impedance element VR are coupled to an output of the DC converting circuit 5.

When the degree of lighting control is relatively high (for low optical output), the frequency control circuit 51 performs a control operation so as to reduce the oscillating frequency of the high-frequency oscillating circuit 1. For example, the frequency control circuit 51 may perform a control operation so as to increase the voltage of the fifth pin (control terminal) of the timer integrated circuit IC1 in FIG. 2 or increase the resistance value of the resistor R9 for charging the capacitor C6.

The oscillating frequency of the high-frequency oscillating circuit 1 may be adjusted along with a pulse width of the PWM control circuit 2. After the pulse width of the PWM control circuit 2 reaches a lower limit, the high-frequency oscillating circuit 1 may control the oscillating frequency to be lowered.

When the degree of lighting control is relatively high, the boost ratio control circuit 52 performs a control operation so as to decrease the boost ratio of the step-up chopper circuit 4. For example, a voltage dividing ratio of the voltage dividing circuit including the resistors R11 to R15 and the variable resistor VR1 in FIG. 2 may be controlled to be increased.

The boost ratio of the boost ratio control circuit 52 may be adjusted along with the pulse width of the PWM control circuit 2. After the pulse width of the PWM control circuit 2 reaches the lower limit, the boost ratio of the boost ratio control circuit 52 may be controlled to be decreased.

When the lighting control is relatively high (low optical output), the impedance control circuit 53 performs a control operation so as to lower the impedance value of the variable impedance element VR. The impedance value of the variable impedance element VR may be adjusted along with the pulse width of the PWM control circuit 2. After the pulse width of the PWM control circuit 2 reaches a lower limit, the impedance value may be controlled to be lowered. Alternatively, the impedance value may be controlled to be lowered even before the pulse width of the PWM control circuit 2 reaches the lower limit.

Figure 7:
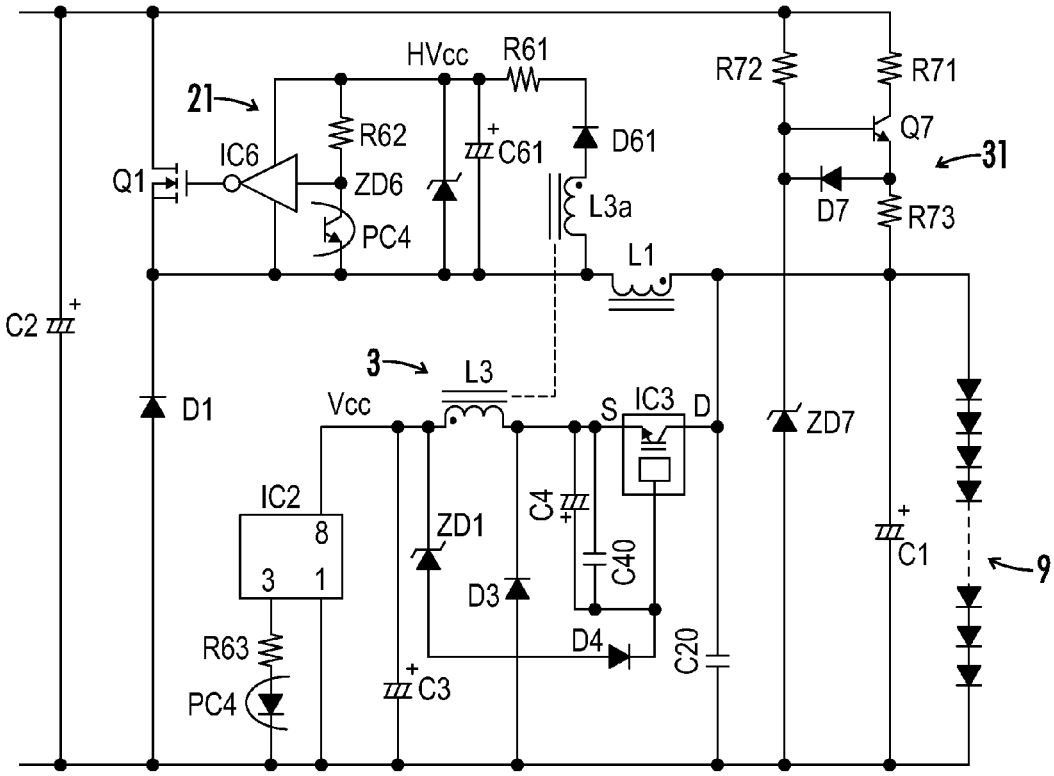
FIG. 7 is a circuit diagram representing another embodiment of an output portion of the lighting device of FIG. 6.
Figure 8A:
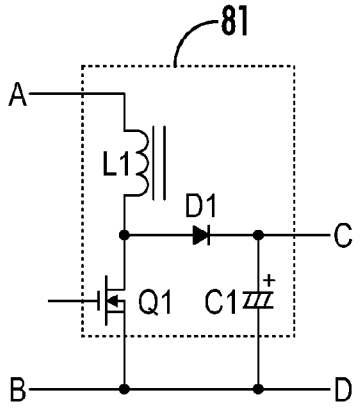
FIGS. 8(*a*)-8(*d*) are circuit diagrams representing various exemplary switching power supply circuits.
Figure 8B:
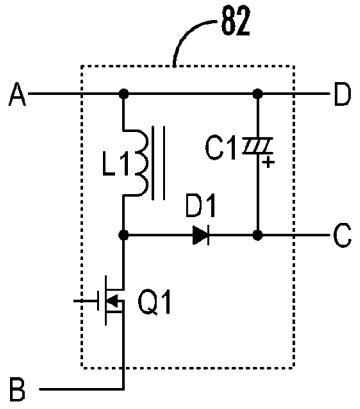
Figure 8C:
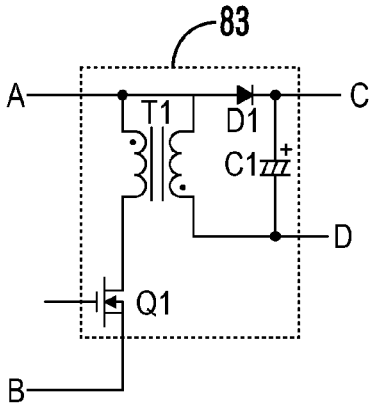
Figure 8D:
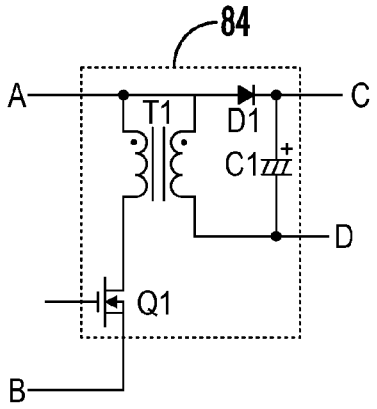

A driving circuit 21 for the switching element Q1 turns on/off the switching element Q1 according to an output signal of the PWM control circuit 2. An example of the driving circuit 21 may be as represented in FIG. 7.

The driving circuit 21 includes an inverting output circuit 106 for turning on/off the switching element Q1 and a high-side power source circuit for supplying an operating power source for the inverting output circuit 106. The high-side power source circuit charges a smoothing capacitor C61 with an output of a secondary winding L3*a* of the inductor L3 of the control power supply circuit 3 arranged on a low-potential side via a diode D61 and a resistor R61, and makes a charging voltage HVcc constant by a Zener diode ZD6. The voltage of the smoothing capacitor C61 is supplied to the inverting output circuit 106 as a power source voltage and is applied to a series circuit including a light-receiving element of a photo-coupler PC4 and a resistor R62. The output of the light-emitting element of the photo-coupler PC4 is provided to the third pin (output terminal) of a low-potential side timer integrated circuit IC2 via a resistor R63.

When the third pin of the timer integrated circuit IC2 as the PWM control circuit 2 is forced High, current flows to the light-emitting element of the photo-coupler PC4 via the resistor R63, and an optical signal is generated. When the resistance value of the light-emitting element of the photo-coupler PC4 decreases after receiving the optical signal, the input voltage of the inverting output circuit IC6 becomes Low and the output voltage of the inverting output circuit IC6 becomes High, thereby turning on the switching element Q1.

When the third pin of the timer integrated circuit IC2 as the PWM control circuit 2 is forced Low, the optical signal of the photo-coupler PC4 disappears and the resistance value of the light-emitting element of the photo-coupler PC4 increases. As a result, the input voltage of the inverting output circuit IC6 becomes High and the output voltage of the inverting output circuit IC6 becomes Low, thereby turning off the switching element Q1.

The inverting output circuit IC6 may be, for example, a general-purpose logic IC inverter or a Schmitt inverter.

An exemplary starting circuit 31 of the control power supply circuit 3 arranged on the low-potential side may now be described. In the initial period after power-on, when the charging voltage of the smoothing capacitor C1 is low, current flows to the smoothing capacitor C1 via a resistor R72, between the base and emitter of a transistor Q7 and a resistor R73, thereby turning on the transistor Q7, and then charging the smoothing capacitor C1 via the resistor R71, between the collector and emitter of the transistor Q7 and the resistor R73. When the charging voltage of the smoothing capacitor C1 reaches a voltage that can start the IPD element IC3 of the control power supply circuit 3, the IPD element IC3 starts the oscillating operation. Thereby, the smoothing capacitor C3 can obtain the low-potential side control power supply voltage Vcc and the smoothing capacitor C61 for the power source for the driving circuit 21 can obtain the high-potential side control power supply voltage HVcc. By obtaining these power source voltages Vcc, HVcc, operation of turning on/off the switching element Q1 is started and the charging voltage of the smoothing capacitor C1 further increases.

A Zener voltage of a Zener diode ZD7 is set to be higher than the startup voltage for the IPD element IC3 of the control power supply circuit 3 and to be lower than a voltage that can illuminate the semiconductor light-emitting element 9 (80 V to 98 V in FIG. 3). For this reason, when the voltage of the smoothing capacitor C1 reaches the voltage that can drive the semiconductor light-emitting element 9 by starting the operation of turning on/off the switching element Q1, current flows in a reverse direction of a path of smoothing capacitor C1, the resistor R73, a diode D7 and the Zener diode ZD7, the base-emitter of the transistor Q7 is reverse-biased. Thereby, the collector-emitter of the transistor Q7 is kept in the OFF state and the starting current is blocked via the transistor Q7.

In the circuit shown in FIG. 7, in a lighting control range of the semiconductor light-emitting element 9 (a range of 50 μA to 300 mA in FIG. 3), a sum of a current consumed by the control power supply circuit 3 and a current consumed via a series circuit including the resistor R73, the diode D7 and the Zener diode ZD7 of the starting circuit 31 is designed to be comparable to or larger than the idling current (6 to 7 mA) flowing to the resistors R1, R2 as with, for example, an embodiment as described above with reference to FIG. 1. Thus, the idling current otherwise uselessly consumed may instead be effectively utilized, thereby advantageously reducing power loss.

Although in various embodiments the step-down chopper circuit is used as the switching power supply circuit, the present invention can be also applied to various switching power supply circuits as represented for example in FIGS. 8(*a*) to 8(*d*). A step-up chopper circuit 81 is represented in FIG. 8(*a*), a step-up and step-down chopper circuit 82 is represented in FIG. 8(*b*), a flyback converter circuit 83 is represented in FIG. 8(*c*) and a forward converter circuit 84 is represented in FIG. 8(*d*). Each circuit is effective to generate an output signal for driving a semiconductor light-emitting element, and includes the switching element Q1 turned on/off at high frequency in series with the DC power source coupled across input terminals A, B, the inductive element (the inductor L1 or the transformer T1) to which a current is intermittently passed from the DC power source via the switching element Q1, the rectifying element (the diode D1) for passing the current flowing from the inductive element (the inductor L1 or the transformer T1), and the smoothing capacitor C1 charged with the current flowing from the inductive element (the inductor L1 or the transformer T1) via the rectifying element (the diode D1), and the semiconductor light-emitting element is coupled across the smoothing capacitor C1 via output terminals C, D. The impedance element (for example, the resistors R1, R2 in FIG. 1) is coupled across the output terminals C, D in parallel so that a minimum operating voltage (for example, voltage of 80 V in FIG. 3) required to light the semiconductor light-emitting element is stably generated even at minimum levels of an on-duty of the switching element Q1.

Figure 9:
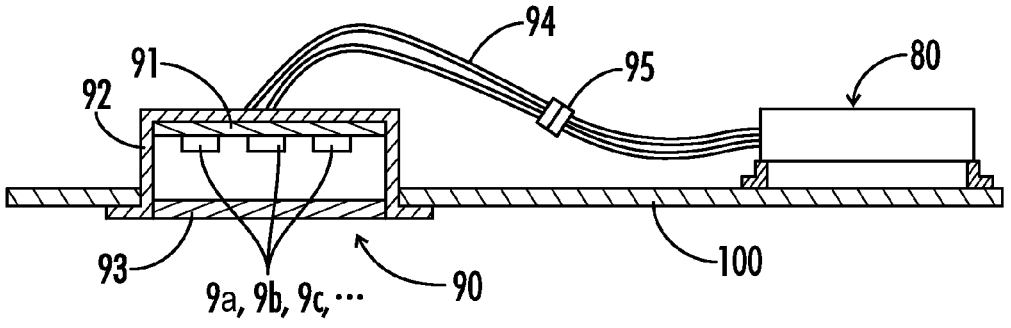
FIG. 9 is a sectional view representing an exemplary configuration of an illumination fixture of the present invention.

An exemplary configuration is represented in FIG. 9 of an LED illumination fixture with a remote power source using the LED lighting device of the present invention. This power source separate-type LED illumination fixture has a lighting device 80 as a power source unit in a case other than a housing 92 of an LED module 90. In this manner, the LED module 90 can be reduced in thickness and the lighting device 80 as a separate-type power source unit can be installed in any of various available locations.

The fixture housing 92 includes a metal cylindrical body having an opened lower end which may be covered with a light diffusing plate 93. The LED module 90 is arranged so as to be opposed to the light diffusing plate 93. An LED mounting substrate is positioned at an upper end of the cylindrical body and LEDs 9*a*, 9*b*, 9*c* . . . of the LED module 90 are mounted thereon. The fixture housing 92 is embedded in a ceiling 100 and is coupled to the lighting device 80 as the power source unit arranged in a ceiling cavity via a lead line 94 and a connector 95.

The circuitry according to the various embodiments described herein may be accommodated in the lighting device 80 as the power source unit. The series circuit (LED module 90) including the LED 9*a*, 9*b*, 9*c*, . . . corresponds to the above-mentioned semiconductor light-emitting element 9.

In an alternative embodiment, the lighting device of the present invention may be applied to a power source integrated-type LED illumination fixture in which the power source unit and the LED module 90 are accommodated in the same housing.

The lighting device of the present invention is not limited to the light source for the illumination fixture as previously described, and may alternatively be used as a light source for backlight of liquid crystal displays and light sources for copiers, scanners and projectors.

Although the light-emitting diode is exemplified as the semiconductor light-emitting element 9 in each of the above-mentioned embodiments, the light-emitting diode is not so limited and may be, for example, an organic EL element or a semiconductor laser element.

The previous detailed description has been provided for the purposes of illustration and description. Thus, although there have been described particular embodiments of the present invention of a new and useful "Lighting Device with Output Impedance Control," it is not intended that such references be construed as limitations upon the scope of this invention except as set forth in the following claims.

What is claimed is:

1. A lighting device comprising:

a DC power source;

a switching power supply further comprising a switching element, an inductive element to which a current is intermittently passed from the DC power source via the switching element, a rectifying element effective to pass the current flowing from the inductive element, and an output capacitor effective to charge and discharge current flowing from the inductive element, first and second ends of said output capacitor defining first and second output terminals for the lighting device, respectively;

switching control circuitry effective to determine a switching frequency and an ON period for the switching element, and to control the switching element to be turned on/off according to the determined frequency and ON period;

a variable impedance element coupled across the output terminals for the lighting device; and an impedance control circuit effective to adjust the impedance of the variable impedance element in association with the determined ON period for the switching element, wherein an impedance value corresponding with a minimum on-duty of the switching element is smaller than an impedance value corresponding with a maximum on-duty of the switching element.

2. The lighting device of claim 1, wherein the switching control circuitry is effective to fix an ON/OFF frequency of the switching element and make an ON period variable.

3. The lighting device of claim 1, wherein the switching control circuitry is effective to fix the ON period of the switching element and make the ON/OFF frequency variable.

4. The lighting device of claim 1, wherein the switching control circuitry is effective to make both the ON period and the ON/OFF frequency of the switching element variable.

5. The lighting device of claim 1, wherein the DC power source is a power factor correction circuit, the lighting device further comprising a boost ratio control circuit effective to control a boost ratio for the power factor correction circuit, wherein the boost ratio corresponding with a minimum on-duty of the switching element is smaller than the boost ratio corresponding with a maximum on-duty of the switching element.

6. The lighting device of claim 1, further comprising lighting control input circuitry effective to receive a lighting control input signal and to generate a lighting control output signal, the switching control circuitry effective to determine a switching frequency and an ON period responsive to the lighting control output signal.

7. A method of operation of a lighting device comprising a switching power supply for generating a DC output voltage across first and second output terminals of the lighting device effective to receive a superconductor light-emitting element, the method comprising:

determining a switching frequency and an ON period for a main switching element in the power supply, and controlling the switching element to be turned on/off according to the determined frequency and ON period;

providing a variable impedance element across the output terminals for the lighting device;

controllably adjusting an impedance value of the variable impedance element wherein an impedance value corresponding with a minimum on-duty ratio of the switching element is smaller than an impedance value corresponding with a maximum on-duty ratio of the switching element.

8. The method of claim 7, the lighting device further comprising a power factor correction circuit effective to generate a DC power input to the switching power supply, the method further comprising the step of controlling a boost ratio for the power factor correction circuit corresponding with a minimum on-duty of the switching element to be smaller than a boost ratio corresponding with a maximum on-duty of the switching element.

9. The method of claim 7, further comprising the step of receiving a lighting control input signal representative of a desired lighting output, the step of determining a switching frequency and an ON period for a main switching element in the power supply further comprising determining a switching frequency and an ON period responsive to the lighting control input signal.

10. The method of claim 9, the step of determining a switching frequency and an ON period responsive to the lighting control input signal further comprising fixing an ON/OFF frequency of the switching element and making an ON period variable.

11. The method of claim 9, the step of determining a switching frequency and an on-duty ratio responsive to the lighting control input signal further comprising fixing the ON period of the switching element and making the ON/OFF frequency variable.

12. The method of claim 9, the step of determining a switching frequency and an ON period responsive to the lighting control input signal further comprising making both of the ON period and the ON/OFF frequency of the switching element variable.

13. An illumination fixture comprising:

a first housing further comprising a cylindrical body having an opened first end, a light diffusing plate positioned across the opened first end, an LED mounting substrate positioned at a second end of the cylindrical body, and an LED module mounted on the LED mounting substrate;

a second housing further defining an interior within which is disposed an LED lighting device having first and second output terminals electrically coupled to the first housing and the LED module, the lighting device further comprising a DC power source, a switching power supply further comprising a switching element, an inductive element to which a current is intermittently passed from the DC power source via the switching element, a rectifying element for passing the current flowing from the inductive element, and an output capacitor effective to charge and discharge current flowing from the inductive element, first and second ends of said output capacitor associated with said first and second output terminals of the lighting device, respectively, switching control circuitry effective to determine a switching frequency and an ON period for the switching element, and to control the switching element to be turned on/off according to the determined frequency and ON period, a variable impedance element coupled across the output terminals of the lighting device, and an impedance control circuit effective to adjust the impedance of the variable impedance element in association with the determined ON period, wherein an impedance value corresponding with a minimum on-duty ratio of the switching element is smaller than an impedance value corresponding with a maximum on-duty ratio of the switching element.

14. The illumination fixture of claim 13, wherein the switching control circuitry is effective to fix an ON/OFF frequency of the switching element and make an ON period variable.

15. The illumination fixture of claim 13, wherein the switching control circuitry is effective to fix the ON period of the switching element and make the ON/OFF frequency variable.

16. The illumination fixture of claim 13, wherein the switching control circuitry is effective to make both the ON period and the ON/OFF frequency of the switching element variable.

17. The illumination fixture of claim 13, wherein the DC power source is a power factor correction circuit, the lighting device further comprising a boost ratio control circuit effective to control a boost ratio for the power factor correction circuit, wherein the boost ratio corresponding with a minimum on-duty of the switching element is smaller than the boost ratio corresponding with a maximum on-duty of the switching element.

18. The illumination fixture of claim 13, further comprising lighting control input circuitry effective to receive a lighting control input signal and to generate a lighting control output signal, the switching control circuitry effective to determine a switching frequency and an ON period responsive to the lighting control output signal.

* * * * *